US007090369B1

(12) United States Patent
Jordan

(10) Patent No.: US 7,090,369 B1
(45) Date of Patent: Aug. 15, 2006

(54) MAGNETIC DEVICE FOR ROTATING FLOATING CANDLE

(76) Inventor: Ephrian Jordan, 1630 Gateway Dr., Vallejo, CA (US) 94589

( * ) Notice: Subject to any disclaimer, the term of this patent is extended or adjusted under 35 U.S.C. 154(b) by 192 days.

(21) Appl. No.: 10/805,837

(22) Filed: Mar. 22, 2004

(51) Int. Cl.
*F21V 5/00* (2006.01)

(52) U.S. Cl. ..... 362/170; 362/324; 362/396; 431/35

(58) Field of Classification Search ..... 362/154, 362/161, 171, 174, 177, 319, 324, 170; 431/35, 431/279, 396, 289
See application file for complete search history.

(56) References Cited

U.S. PATENT DOCUMENTS 4,240,783 A * 12/1980 Nevin et al. ..... 431/253
6,709,266 B1 * 3/2004 Jensen ..... 431/296
6,799,965 B1 * 10/2004 Gaudioso ..... 431/35

* cited by examiner

*Primary Examiner*—John Anthony Ward
(74) *Attorney, Agent, or Firm*—Charles L. Thoeming; Jack Lo

(57) ABSTRACT

A magnetic device for rotating a floating candle is comprised of a first magnetic member for attaching to the base of the candle, a transparent container for holding water to float the candle, and a base for supporting the transparent container. A second magnetic member is rotated by a motor inside the base. A decorative cover is positioned around the base. When the second magnetic member is rotated, the first magnetic member and thus the candle are caused to rotate by magnetic attraction to produce a pleasing rotating flame.

9 Claims, 2 Drawing Sheets

MAGNETIC DEVICE FOR ROTATING FLOATING CANDLE

BACKGROUND OF THE INVENTION

1. Field of the Invention

The invention broadly relates to candles.

2. Prior Art

Some candles are embedded in heat resistant containers which may float on water.

BRIEF SUMMARY OF THE INVENTION

Objects of the present invention are:

to rotate a candle floating on water to produce a pleasing rotating flame;

to rotate the candle without a mechanical connection; and to be able to rotate candles of different sizes.

A magnetic device for rotating a floating candle is comprised of a first magnetic member for attaching to the base of the candle, a transparent container for holding water to float the candle, and a base for supporting the transparent container. A second magnetic member is rotated by a motor inside the base. A decorative cover is positioned around the base. When the second magnetic member is rotated, the first magnetic member and thus the candle are caused to rotate by magnetic attraction to produce a pleasing rotating flame.

DRAWING REFERENCE NUMERALS

10. Floating Candle
11. Magnetic Member
12. Container
13. Base
14. Housing
15. Fuel
16. Wick
17. Plate
18. Magnetic Member
19. Motor
20. Upper Housing
21. Lower Housing
22. Magnets
23. Spindle
24. Cover
25. Opening
26. Controls
27. Water
28. Claw

DETAILED DESCRIPTION OF THE INVENTION

Figure 1:
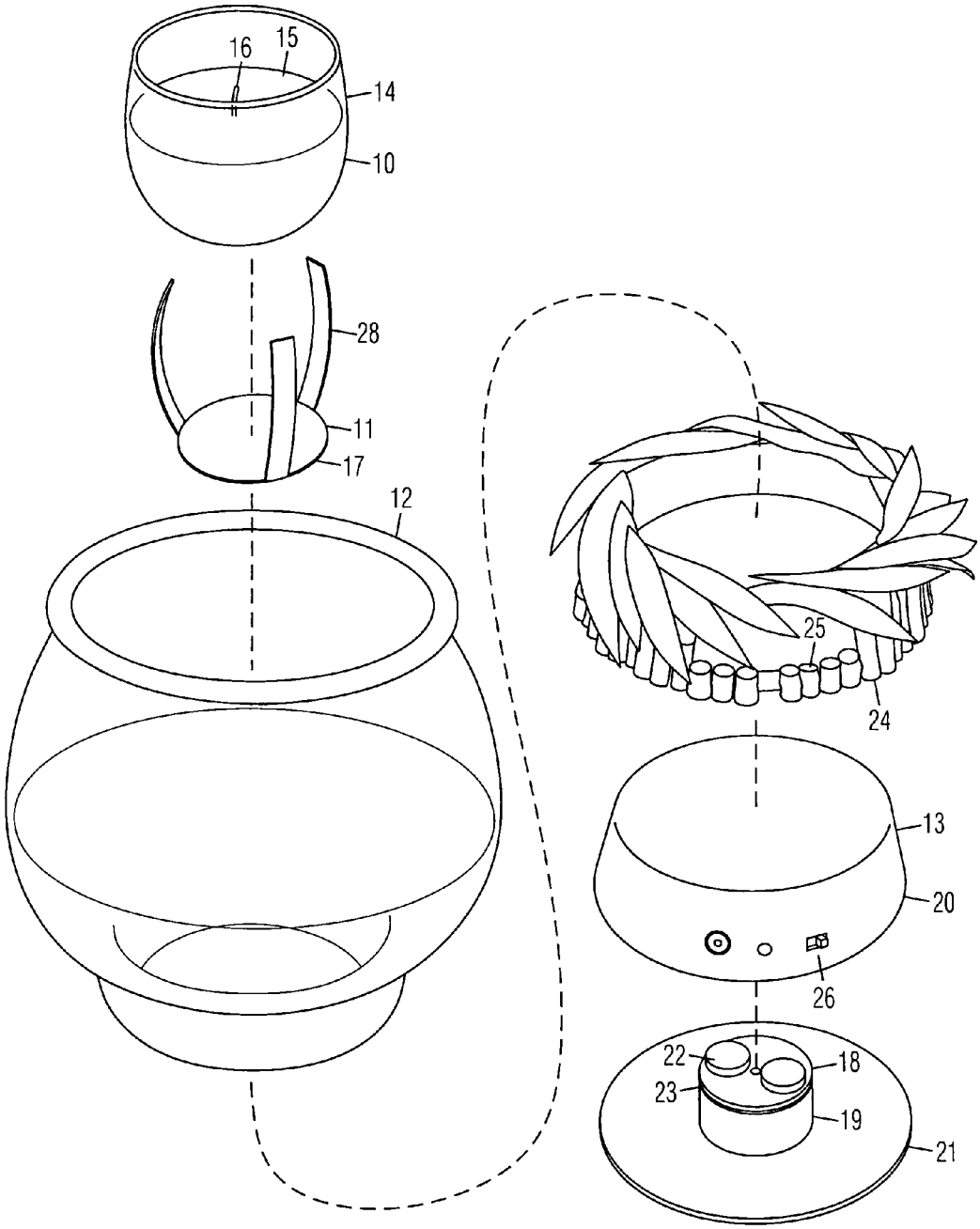
FIG. 1 is an exploded perspective view of the magnetic device for rotating a floating candle.

FIG. 1:

A preferred embodiment of a magnetic device for rotating a floating candle 10 shown in FIG. 1 is comprised of a first magnetic member 11 for attaching to the base of floating candle 10, a circular transparent container 12 for holding water to float candle 10, and a base 13 for supporting transparent container 12.

Floating candle 10 is comprised of an open top housing 14 with a fuel 15 inside and a wick 16 in fuel 15. Housing 14 is preferably a glass jar. First magnetic member 11 is preferably comprised of a steel clip for clipping onto the bottom of candle. Clip is preferably comprised of spring claws 28 projecting up from a plate 17. Claws 28 are flexible inward and outward to accommodate candles of different sizes.

A second magnetic member 18 is rotated by a motor 19 inside base 13, which is comprised of an upper housing 20 and a lower housing 21. Second magnetic member 18 is preferably comprised of magnets 22 on a spindle 23 attached to motor 19. Magnets 22 are each mounted with their poles along a vertical axis, so that one of the poles of each magnet is facing up for maximum attraction on first magnetic member 11. In this example, there are a plurality of magnets 22 mounted eccentrically to motor 19. There may be any number of magnets.

In this example, first magnetic member 11 is comprised of a magnetic material, such as steel, which is attracted by a magnet. Second magnetic member 18 is comprised of magnets.

Alternatively, first magnetic member 11 may be comprised of one or more magnets, and second magnetic member 18 may be comprised of a material which is attracted by a magnet.

A decorative cover 24 is for being positioned around base 13. Decorative cover 24 is comprised of a circular sleeve with an open bottom, and an opening 25 on a side to expose controls 26 on base 13.

Figure 2:
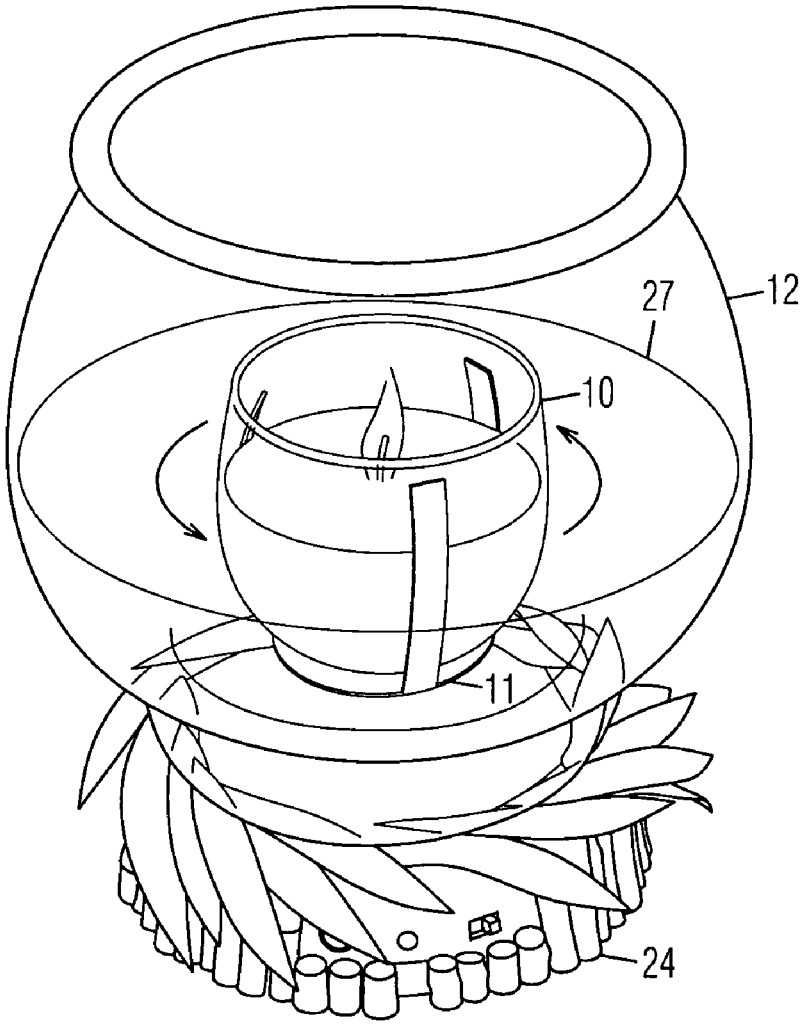
FIG. 2 shows the assembled device in operation.

FIG. 2:

The device for rotating floating candle 10 is shown assembled in FIG. 2. Decorative cover 24 is positioned on base 13. Transparent container 12 is positioned on base 13 and partially filled with water 27. Floating candle 10 is placed on a suitable volume of water for suspending floating candle 10 a small distance, such as 0.5 inch, above a bottom of container 12. When the motor is activated to rotate the second magnetic material, first magnetic member 11 and thus floating candle 10 are caused to rotate by magnetic attraction to produce a pleasing rotating flame.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A device for rotating a floating candle, comprising:

a first magnetic member for attaching to a base of the candle;

a transparent container for holding fluid for floating the candle;

a base under the transparent container;

a second magnetic member positioned inside the base under the transparent container and rotated by a motor for rotating the candle by magnetic coupling between the first magnetic member and the second magnetic member; and motor controls on the base under the transparent container.

2. The device for rotating the floating candle of claim 1, wherein the first magnetic member is comprised of a steel clip for clipping onto a bottom of the candle, and the clip is comprised of spring claws projecting up from a plate, wherein the claws are flexible inward and outward to accommodate candles of different sizes.

3. The device for rotating the floating candle of claim 1, wherein the second magnetic member comprised of magnets eccentrically mounted on a spindle attached to the motor.

4. The device for rotating the floating candle of claim 1, further including a decorative cover positioned around the base, wherein the decorative cover is comprised of a circular sleeve with an open bottom, and an opening on a side to expose controls on the base.

5. A candle device, comprising a floatable candle comprised of an open-top housing with a fuel inside and a wick in the fuel;

a first magnetic member attached to a base of the candle;

a transparent container for holding fluid to float the candle;

a base under the transparent container;

a second magnetic member positioned inside the base under the transparent container and rotated by a motor to rotate the candle by magnetic coupling said the first magnetic member and the second magnetic member; and motor controls on the base under the transparent container.

6. The device for rotating the floatable candle of claim 5, wherein the first magnetic member is comprised of a steel clip clipped onto a bottom of the candle, and the clip is comprised of spring claws projecting up from a plate.

7. The device for rotating the floatable candle of claim 5, wherein the second magnetic member is comprised of magnets eccentrically mounted on a spindle attached to the motor.

8. The device for rotating the floatable candle of claim 5, further including a decorative cover positioned around the base, wherein the decorative cover is comprised of a circular sleeve with an open bottom, and an opening on a side to expose the motor controls.

9. A candle device, comprising a floatable candle comprised of an open-top housing with a fuel inside and a wick in the fuel;

a first magnetic member attached to a base of the candle, wherein the first magnetic member is comprised of a steel clip for clipping onto a bottom of the candle, and the clip is comprised of spring claws projecting up from a plate;

a transparent container for holding fluid to float the candle;

a base under the transparent container;

a second magnetic member positioned inside the base under the transparent container and rotated by a motor to rotate the candle by magnetic coupling between the first magnetic member and the second magnetic member, wherein the second magnetic member is comprised of magnets eccentrically mounted on a spindle attached to the motor; and motor controls on the base under the transparent container.

* * * * *